United States Patent [19]

Bell

[11] 3,958,143

[45] May 18, 1976

[54] LONG-WAVELENGTH PHOTOEMISSION CATHODE

[75] Inventor: Ronald L. Bell, Woodside, Calif.

[73] Assignee: Varian Associates, Palo Alto, Calif.

[22] Filed: Mar. 8, 1974

[21] Appl. No.: 449,292

Related U.S. Application Data

[63] Continuation-in-part of Ser. No. 323,552, Jan. 15, 1973, abandoned.

[52] U.S. Cl. ..... 313/94; 357/3; 357/4; 357/16; 357/30

[51] Int. Cl.[2] ..... H01J 39/06; H01J 31/26

[58] Field of Search ..... 313/94

[56] References Cited

UNITED STATES PATENTS

| | | | |
|---|---|---|---|
| 3,387,161 | 6/1968 | Van Laar et al. | 313/94 |
| 3,631,303 | 12/1971 | Antypas et al. | 313/346 |
| 3,632,442 | 1/1972 | Turnbull | 313/94 |
| 3,644,770 | 2/1972 | Bell | 313/94 |
| 3,651,426 | 3/1972 | Boatner et al. | 357/30 |
| 3,694,759 | 9/1972 | Kasano et al. | 330/4.9 |
| 3,814,993 | 6/1974 | Kennedy | 357/30 |

OTHER PUBLICATIONS

James et al., Journal of Applied Physics, Vol. 42, No. 2, Feb. 1971, pp. 580–586.

Pankove, RCA Technical Note No. 767 Apr. 1968.

Milnes et al., Heterojunctions and Metal-Semiconductor Junctions, (Academic Press, N.Y. 1972), pp. 201–225. Metal–Semiconductor Stolte et al., "The Schottky Barrier Cold Cathode, " Solid–State Electrons; Pergamon Press, 1969, Vol. 12, pp. 945–954.

Stolte et al., The Schottky Barrier Cold Cathode; Solid–State Electronics, Pergammon Press, 1969; Vol. 12, pp. 945–954, Great Britain; p. 945 cited.

Burnham et al., $Al_xGa_{1-x}As_{1-y}'P_y$–$GaAs_{1-}P_y$ Heterostructure Laser and Lamp Junctions, Applied Physics Letters, Vol. 17, No. 10, Nov. 15, 1970, pp. 455–457 cited.

*Primary Examiner*—Robert Segal

*Attorney, Agent, or Firm*—Stanley Z. Cole; D. R. Pressman; Robert K. Stoddard

[57] ABSTRACT

A long wavelength photoemitter, for example a III-V semiconductor, having a work function reduction activation layer thereon, with means for overcoming the energy barrier between the semiconductor conduction band edge and the vacuum comprising means for thermally energizing the photoexcited electrons in the conduction band from a lower energy level therein to a higher "metastable" energy level in which they may reside for a sufficient time such that the electrons can pass with high probability from the elevated energy level into the vacuum over the energy barrier. In one embodiment, promotion of electrons to this higher energy level in the conduction band results from proper selection of the semiconductor alloy with conduction band levels favoring such room temperature thermal excitation. In another embodiment, a Schottky barrier is formed between the semiconductor emitter surface and the activation layer, by means of which an internal electric field is applied to the cathode resulting in high effective electron temperature for energy level transfer analogous to the intervalley electron transfer process of the Gunn effect. In yet other embodiments, composite semiconductor bodies are fabricated in which one region may advantageously be designed for efficient absorption of long-wavelength photons, and another for efficient operation of the promotion mechanism, which together assure a high quantum efficiency. Other properties of the biased promotion layer may be used to minimize emission of electrons which have been excited by purely thermal means, thus providing a low dark current, usually considered to be incompatible with long-wavelength infrared response.

2 Claims, 14 Drawing Figures

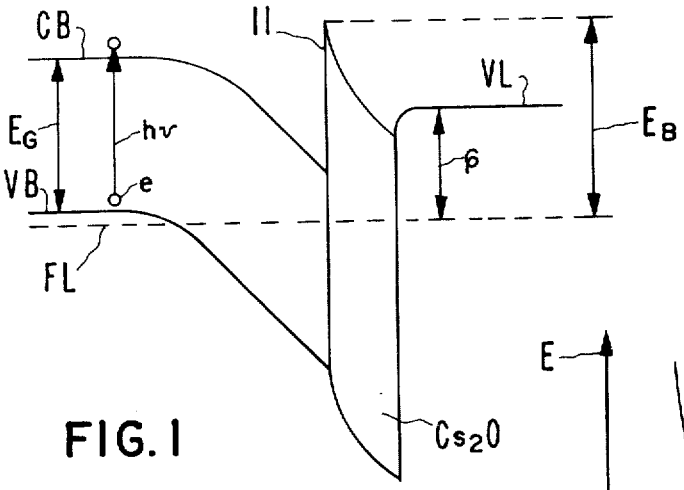
FIG. 1
FIG. 2
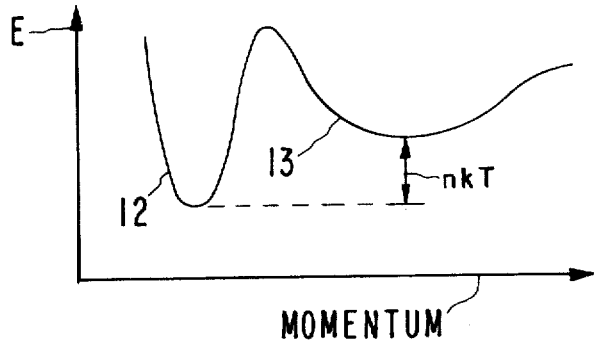
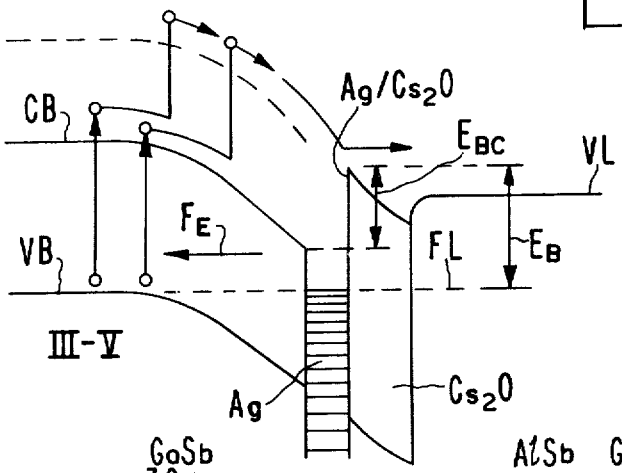
FIG. 4
FIG. 3
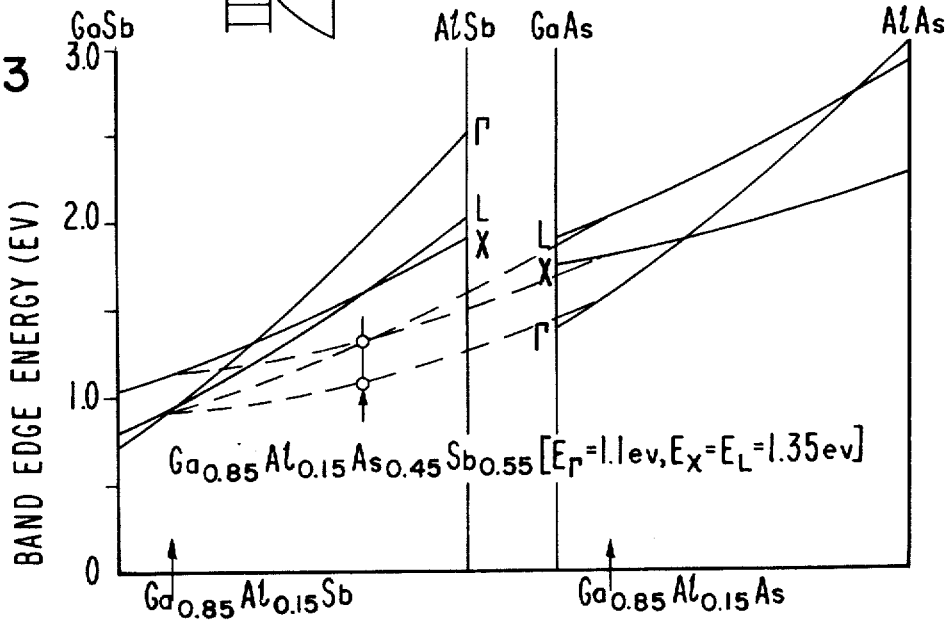

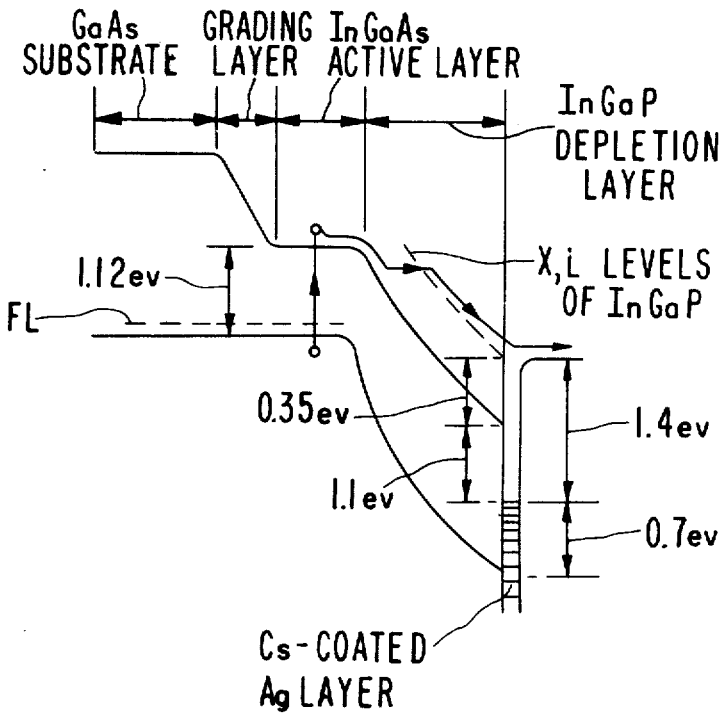
FIG.11
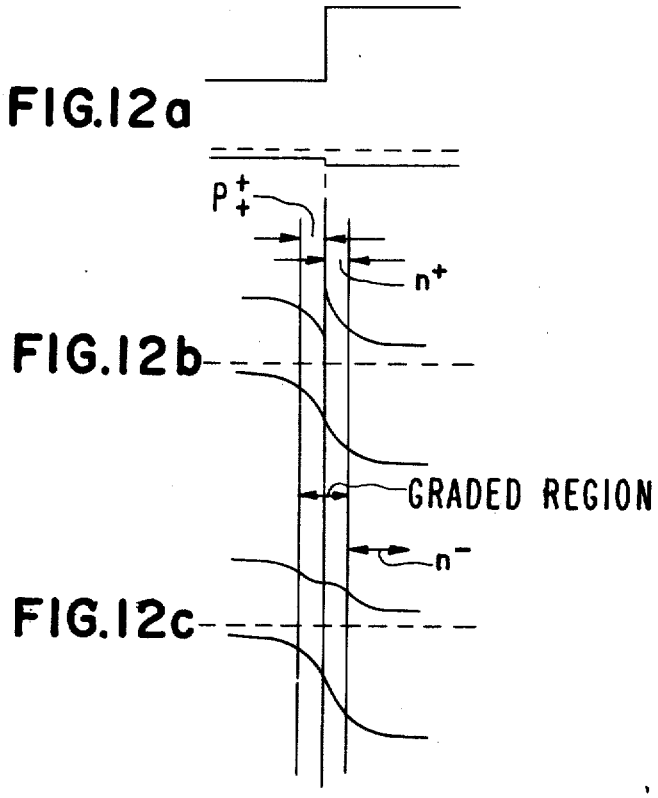

LONG-WAVELENGTH PHOTOEMISSION CATHODE

CROSS REFERENCE TO RELATED APPLICATIONS

This application is a Continuation-in-Part of parent application Ser. No. 323,552, filed Jan. 15, 1973, now abandoned entitled "A Long Wavelength Photoemission Cathode," by Ronald L. Bell, which is assigned to the present assignee.

BACKGROUND OF THE INVENTION

A substantial effort has been expended to extend the detectable wavelength of the III-V semiconductor photoemitters beyond the wavelength of about $\lambda = 1.24\mu$, i.e., below 1.0 eV photon energy.

In general, there are basic limitations on the wavelength response of photoemitters, for example, the work function $\epsilon$. In so-called "negative affinity" photoemitters, it has been shown that the "interfacial" barrier between the semiconductor and the activator is also an important limitation. In order to extend the detectable wavelength, such limitations must be overcome.

The most effective semiconductor photoemitters are P-type structures where the Fermi level more or less coincides with the valence band of the electrons in the bulk semiconductor. In the so-called multialkali photocathodes, the energy difference between the Fermi level at the semiconductor surface and the vacuum level, known as the work function $\epsilon$, is greater than the energy difference between the valence band and the conduction band of the electrons in the semiconductor, and the energy $h\nu$ of photons impinging on the semiconductor must be great enough to promote the electrons from the valence band to the higher energy conduction band and from the conduction band over the vacuum level at the surface of the semiconductor, i.e., $h\nu > \epsilon$.

The negative affinity III-V form of semiconductor photoemitter lowers the effective $\epsilon$ by the well known band-bending at the electron emitting surface of the semiconductor. The bending lowers the edges of the valence band and the conduction band at the semiconductor surface relative to the band edges in the bulk semiconductor, and effectively lowers the vacuum level relative to the conduction level, decreasing the height of the barrier to the electrons seeking to escape over the vacuum level.

Since the difference between the conduction band and the vacuum level is known as electron affinity, semiconductor devices employing band-bending wherein the vacuum level has effectively been made lower than the conduction band are referred to as negative-affinity devices.

In these negative affinity devices, it is also necessary that the photon energy $h\nu$ be greater than the band gap, i.e., the energy $E_G$ between the valence band and the conduction band, or $$h\nu \quad E_G$$

in order to obtain absorption of the photon and creation of the electron hole pairs. If the conduction level, while higher than the vacuum level so that no problem exists in having the electrons escape from the conduction level to the vacuum, is so high as to create a large bandgap, absorption of the photons and promotion of the electrons from the valence band to the conduction band does not take place and few electrons are emitted.

By proper selection of the III-V material, the bandgap $E_G$ can be lowered such that a profusion of electrons are promoted to the conduction band, but, as a result of the $E_G$ lowering, the conduction band falls below the vacuum level and the work function $\epsilon$ may prevent the electrons from escaping from the conduction band into the vacuum.

As a consequence of those conditions, a significant problem with electron emission from photoemitters such as III-V semiconductors is the work function $\epsilon$. A considerable amount of work has been directed to lowering the work function of semiconductors; it has been shown that suitable surface activation with $Cs_2O$ can substantially reduce the work function, to as low as 0.6 eV, i.e., corresponding approximately to photons of $2\mu$ wavelength.

It would seem then that by selecting a III–V semiconductor with band bending and with a low $E_G$, and by activating the surface with $Cs_2O$ to reduce the work function, a very good long wavelength photoemitter should result. However, although such a device provides negative-affinity as desired, the junction between the III–V semiconductor and the other semiconductor material $Cs_2O$ forms a large heterojunction barrier, and this interfacial barrier is higher than the vacuum level and the conduction band. This interfacial barrier height $E_B$ is typically about 1.15 eV and it prevents the desired long wavelength responsive photoemission. For a discussion of the interfacial barrier on III–V compounds see "Behavior of Cesium Oxide as a Low Work Function Coating" by J. Uebbing and L. James, Journal of Applied Physics, Vol. 41, No. 11, October 1970, pages 4505 to 4516, inclusive. Although some disagreement exists relative to the exact nature of this interfacial barrier as seen by reference to the articles "Long-Wavelength Photoemission From $Ga_{1-x}In_xAs$ Alloys" by D. G. Fisher et al, Applied Physics Letters, Vol. 18, No. 9, May 1, 1971, pages 371–373, "Interfacial Barrier Effects in III-V Photoemitters" by R. Bell et al, Applied Physics Letters, Vol. 19, No. 12, Dec. 15, 1971, pages 513–515, and "Photo-electron Surface Escape Probability of (Ga, In) As : Cs-O in the 0.9 to ~ 1.6$\mu$ m Range," Journal of Applied Physics, Vol. 43, No. 9, September 1972, pages 3815–3823, this barrier is clearly seen to prevent the escape of electrons from the conduction band to the vacuum, and to prevent attainment of efficient long wavelength infrared photoemission from III-V compounds.

The devices previously proposed for increased photoemission at long wavelengths involve multiple layer growths, uniform large-area operation of heterojunctions, biased layers, etc. leading to problems in surface and bulk nonuniformities in the grown layers, particularly where more than one heteroepitaxial layer is to be grown. In the case of approaches relying on tunneling through thin insulator layers, non-uniformity, already a serious problem with other than the simplest unbiased III-V negative affinity system, is a dominant and disabling phenomenon.

SUMMARY OF THE PRESENT INVENTION

The present invention provides a long wavelength photoemitter, for example, a negative affinity III-V type, having a work function reducing activation layer and produced by straightforward growth, fabrication, and activation procedures, the photocathode employing novel techniques for overcoming the energy barrier between the semiconductor conduction band edge and the vacuum, resulting in high, uniform sensitivity over large areas as desired for infrared photocathodes.

In the photocathodes of the present invention, the electrons in the semiconductor are first promoted by photo-excitation from the valence band into the conduction band, and the electrons are thereafter promoted by thermal energy means into higher levels in the conduction band from where they may pass over the interfacial barrier and into the vacuum. In a preferred embodiment of the invention, a simple biased Schottky barrier is employed between the semiconductor and the activation layer, and the photoexcited electrons are promoted into higher levels of the conduction band by application of a moderate electric field, this effect being the intervalley electron transfer effect responsible inter alia for the microwave Gunn effect.

In another embodiment of the invention, the semiconductor compound is chosen such that the upper conduction band or valley of the semiconductor has a relatively high density of electron energy states, as for example, the zone-edge L or X band edges, compared to the gamma minimum, such that an appreciable number of the photoexcited electron population, when thermalized at 300° K (room temperature), will be excited to the upper state, which may be as high as 0.1 to 0.2 eV above the gamma minimum. Electron emission into vacuum directly from the upper conduction band state over the surface energy barrier (work function or interfacial barrier) takes place with a significantly higher transmission efficiency (escape probability) than possible from the gamma minimum.

In other embodiments to be described below, photoexcitation may occur in one region of a composite semiconductor body and promotion to a higher conduction band in another region. The different materials of these regions may be designed to optimize their separate functions, the common requirements being that it should be possible to grow one on the other by some convenient method, for example, epitaxial growth, and that it should be possible to transfer electrons from the conduction band of the photon absorbing layer to the conduction band of the electron promotion layer. These requirements can be satisfied in the systems discussed below.

BRIEF DESCRIPTION OF THE DRAWINGS

FIG. 1 is a model for a photoemitter cathode which incorporates one embodiment of the present invention.

FIG. 2 is a plot showing low energy and high energy valleys in the conduction band of a photoemitter cathode of FIG. 1.

FIG. 3 is an illustration of the band edge energy in a particular III–V compound (GaAlAsSb) utilized in one embodiment of this invention.

FIG. 4 is a model of a second form of photoemission cathode incorporating a second embodiment of the present invention and utilizing a Schottky barrier therein.

FIG. 11 is a band edge plot of a low dark current GaAs/InGaAs/InGaP cathode.

FIG. 12 is a series of band edge plots showing a technique for handling discontinuities in the conduction band edges at the heterojunction.

DESCRIPTION OF THE PREFERRED EMBODIMENTS

Figure 5:
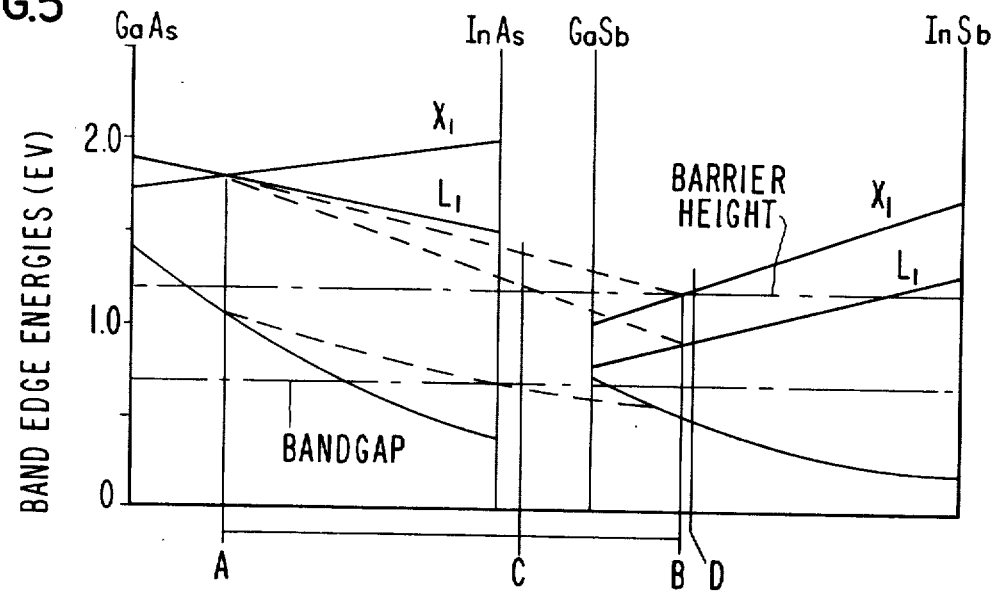
FIG. 5 is a plot of the band edge energies of a quaternary form of III–V cathode.

Referring now to FIG. 1 there is shown a model of the well known III-V semiconductor negative affinity photocathode with the interfacial barrier 11 between the III-V surface and the activation layer $Cs_2O$. By choosing a III-V compound with a relatively low bandgap $E_G$, for example, 0.8 eV, a profuse number of electrons may be excited by the incoming photon energy $h\nu$ from the valence band (VB) to the conduction band (CB). By band bending, the vacuum level (VL) has been reduced below the conduction band edge (CB) in the bulk semiconductor for negative affinity, and the work function $\epsilon$ between the Fermi level (FL) and the vacuum level (VL) has been reduced by the activation layer $Cs_2O$. Therefore, a low bandgap, low work function, negative affinity device is provided; however, efficient photoemission is prevented by the height $E_B$ of the interfacial barrier formed between the two semiconductor surfaces. The Uebbing and James article cited above shows this interfacial barrier height $E_B$ to be about 1.15 eV.

A very strong laser line exists at about $\lambda = 1.06\mu$, or 1.17 eV, and therefore a barrier $E_B$ of such height causes the photoemissive response of the cathode represented by this model to fall off appreciably at this laser line. Reducing the $E_B$ height even slightly enables the photocathode to operate well on this laser line.

It is the purpose of the present invention to make use of thermal agitation of the photoexcited electrons in the conduction band to overcome the energy barrier, for example, the interfacial barrier, so that the electrons escape into the vacuum. In one method, the thermal energies of the photo-excited electrons are used to overcome the energy barrier. With electrons in a single system and at different energies, for example, electrons in free space, the Boltzmann distribution establishes the probability of the electrons being at a particular kinetic energy E of $$p(E) \sim \exp(-E/kT)$$

and, therefore, the higher the kinetic energy E, the less probability of having an electron at that higher energy. But, with a finite temperature T of 300° K, a finite probability does exist.

In the semiconductor body of the cathode, the electrons are not found in a single system, and the electrons in the conduction band are found in several different systems with different masses. The energy E versus momentum is plotted in FIG. 2 for electrons in two of the possible systems in a III-V compound, with the lowest conduction band in the III-V material having a very high curvature 12, i.e., a low mass, and therefore a low density of quantum-mechanical energy states. The other region 13 of the conduction band has a low curvature, i.e., high mass and therefore a high density of energy states. As a result, the probability relationship given above includes a density-of-states function such that $$p(E) \sim [g(E)] \exp(-E/kT)$$

Therefore, with one region 13 of the conduction band having a high density of states while another region 12 of the conduction band has a low density of states, the ratio of the upper band g(E) to the lower band g(E) can be relatively large. Electrons promoted into the lower energy, light mass conduction band region 12 by photoexcitation, will, because of the higher probability factor, be transported into the high state density band 13 because of the large number of energy states that will accept them. This will occur by thermal excitation provided T is finite, as for example room temperature, and provided the energy difference between the lower and higher energy conduction band regions is small enough, e.g. 3kT.

Certain III-V alloys will give the correct conduction band structure, i.e., those in which the zone-edge L and X band edges have very high energy state densities relative to the gamma minimum, and an appreciable fraction of the photoexcited population, even when thermalized at room temperature, will be found in the upper states. These upper states are as high as 0.1 to 0.2 eV above the gamma minimum, and this energy difference is significant when only a slight energy increase is needed to overcome the energy barrier as in the laser line illustration mentioned above. Thus electron emission into vacuum directly from the upper states over the heterojunction barrier takes place with a significantly higher transmission efficiency ("escape probability") than possible from the gamma minimum. Assuming parabolic band edges, at energies E1 and E2, with multiplicities $g1$ and $g2$, effective masses $m1$ and $m2$, and an absolute temperature T, the ratio of upper to lower populations is given by $$N2/N1 = (g2/g1)\,(m2/m1)^{3/2} \exp(E1-E2)/kT$$

For $g2/g1 = 7$, $m2/m1 = 10$, $T = 300°K$, and $E2-E1 = 0.1$ eV, $N2/N1 = 4.6$, a satisfactorily high value.

Some loss in diffusion length can be expected because of the higher mass of the upper valley electron population, and the lower mobility. This effect is small, being proportional to the square root of the effective mass, whereas the population varies as the 3/2 power of the effective mass. Moreover, the lifetime against recombination in the upper (indirect) levels may be significantly higher than for the gamma electrons, offsetting any decrease in mobility.

The requisite band structure is realized by the quaternary III-V alloy system GaAlAsSb as illustrated in FIG. 3. It is seen that the band edge energies $E_X$ and $E_L$ are 1.35 eV and the gamma minimum is 1.1 eV for the illustrative compound $$Ga_{0.85}\,Al_{0.15}\,As_{0.45}\,Sb_{0.55}$$

A more preferred embodiment of the invention is shown by the model of FIG. 4 wherein a biased Schottky barrier is formed between the III-V semiconductor and the $Cs_2O$ activation layer by a thin (100 A) silver layer on the semiconductor surface under the activation layer. Such a thin silver layer with Cs activation has been employed on cold cathode emitters; for example, see Stolte and Archer, "pn - Schottky Hybride Cold-Cathode Diode," Applied Physics Letters, Vol. 19, No. 11, Dec. 1, 1971.

As in the unbiased photocathode, the initial action is the absorption of the photon across a direct bandgap $E_G$ of, for example, 0.8eV (giving a sharp onset of optical absorption and a high $\alpha$ under operating conditions, conducive to efficient operation). As discussed below, it may be possible to operate with bandgaps as low as 0.46 eV, corresponding to a long wavelength cut-off of 2.7 microns. The additional energy provided to the photoexcited electrons in order for them to be emitted into vacuum relies on hot-carrier effects and intervalley electron transfer, phenomena which are the basis of the microwave Gunn effect, and are now relatively well understood. The Gunn effect and other useful microwave effects ensue when a moderately strong electric field $F_E$— a few kV/cm— is applied to a semiconductor with a light-mass Γ conduction band minimum and heavy mass minima at a higher energy. Electrons in the Γ minimum gain energy from the electric field until they are energetic enough to transfer into the upper valleys. Here the mobilities are low enough and the scattering mechanisms strong enough that for the fields applied, the electron population gains no further significant energy, and ionization across the forbidden gap is prevented. The avalanching range of fields is moved to much higher values ($\sim 10^5$ V/cm) by the presence of these higher "satellite" valleys of the conduction band. Because of the relatively high densities of states in the upper conduction band minima, a significant fraction of the photoelectrons are transferred into these upper levels; this high fractional transfer is important for the quantum efficiency and noise properties of the resulting photocathode.

In utilization of this effect, the equivalent electron effective temperatures obtained are much higher than the lattice temperature of the order of several thousand °K. As discussed above, electrons present in the conduction band can be promoted much higher up in the energy levels of the conduction band to more easily pass over the energy barrier at the surface. Alternatively, the gamma minimum for the semiconductor can be lower and still obtain promotion up to the X or L minimum to pass over the barrier, while still obtaining absorption at long wavelengths due to absorption into the gamma minimum.

In Gunn-effect devices, very large currents flow under the action of the applied electric field, whereas in the present structure the only current flowing is due to photoexcited electrons, a substantial fraction of which are emitted into vacuum. Very high photoelectron quantum efficiencies are therefore available.

The important consequences of a proper choice of band structure for the cathode are: (a) efficient absorption of the incoming photons near the surface (direct bandgap), (b) excitation of the photoelectrons to well-defined upper levels of the conduction band on applying moderate electric fields, and (c) the action of these upper levels in preventing further runaway and ionization (avalanching) of the semiconductor, before a significant fraction of the photoelectron population has been excited to the higher energy levels.

In order to apply such electric fields, the material under stress must contain few free carriers. This is achieved by compensating the material using "deep" trapping centers, or more easily by sweeping out the carriers, as in the depletion region of a back-biased pn-junction or Schottky-barrier contact. FIG. 4 illustrates the use of the depletion layer of a Schottky barrier, formed by the thin Ag overlayer on the p-type semiconductor. In this configuration, the field increases towards the surface, giving the most rapid available band-bending rate, favorable to emission, just at the surface. While this field can even rise into the higher "avalanching" range just at the surface, without serious detriment to the noise performance, the very high surface band-bending fields of the conventional negative affinity photocathode ($\sim 10^6$ V/cm) are not used, since this gives rise to tunneling of holes from the Schottky barrier into the semiconductor and very large currents which cannot be supported by the thin Ag layer.

Avalanching in high-field devices occurs under conditions in which electrons in the conduction band can reach energies sufficient to create new electron-hole pairs across the bandgap. The relevant kinetic energy is clearly at least equal to the bandgap energy at the gamma point $E_G$, and on a simple theory accounting for momentum conservation is at least as high as 1.5 $E_G$. To avoid avalanching at low fields, before transfer to satellite valleys is effective, the conduction band gamma electron energies are limited to less than 1.5 $E_G$ by placing the satellite valleys at or below this energy.

These considerations, coupled with available surface barrier heights, determine the long wavelength limit of the present device in the following manner. Assuming location of the Ag Fermi level at one-third the bandgap from the valence band (Mead's one-third rule), and an $Ag/Cs_2O$ barrier height of 1.0 eV, this surface barrier will lie at $E_{BC} = 1.0 - 2E_G/3$ above the conduction band edge at the surface. For emission from satellite valleys over this barrier, the height of the satellite valleys $E_S$ above the conduction band edge must be at least equal to $E_{BC}$. However, there is already a limit on $E_S$ due to avalanche prevention: $E_S < 1.5\ E_G$. Therefore, $$1.5\ E_G > E_S > E_{BC} = 1.0 - 2E_G/3\ \text{(eV)}$$

from which is derived a minimum value of the bandgap $$E_G > 0.45\ \text{eV}.$$

The corresponding long wavelength cut-off is 2.7 microns. Since this value is based on a number of assumptions, it is not easily met in actual cases, and the indicated limit is difficult to approach closely in practice.

A more practical approach is to operate at a bandgap $E_G$ of 0.7 eV, corresponding to a cut-off of 1.77 microns. From the one-third rule, the surface Fermi level is pinned at about 0.47 eV below the conduction band edge. The top of the $Ag/Cs_2O$ barrier is then 1.0 eV above this, or 0.53 eV above the conduction band edge of the III-V at the surface. The band structure is therefore such as to generate L or X minima to about 0.53 eV above the bottom of the Γ minimum, or at a level 0.7 + 0.53 = 1.23 eV on the diagram of FIG. 4.

FIG. 5 illustrates the $In_xGa_{1-x}As_ySb_{1-y}$ quaternary system suitable for use in the FIG. 4 Schottky barrier embodiment with the ternary system GaAs/InAs represented on the left and the ternary GaSb/InSb on the right. The binary end-point band structure critical points are taken from Herman et al, Vol. 8, Methods in Computational Physics, Academic Press, 1968, pages 193–250. For illustrative purposes, the higher points are joined by straight lines to represent linear variation across the ternary composition, although it is well known that the actual curves are slightly parabolic.

A bandgap at the Γ-point of 0.7 eV mentioned above is indicated by the horizontal dashed line, and the assumed barrier height of 1.25 eV by the horizontal chain-dashed line. The composition A is $Ga_{.75}In_{.25}As$, the composition B is $Ga_{.75}In_{.25}Sb$, and the composition C is a .64/.36 combination of these, or $Ga_{.75}In_{.25}Sb_{.64}As_{.36}$. The resulting lattice constant is close to that of GaSb which is therefore a convenient substrate for epitaxial growth. The Γ minimum lies at 0.7 eV, and the $L_1$ minima at 1.25 eV. This composition gives field-assisted, hot electron photoemission, when activated with Cs and oxygen, out to wavelengths of 1.77 microns. Although the discussion has been in terms of front-surface photoemission, GaSb is transparent to 0.7 eV radiation at reduced temperature, and the possibility of transmission operation of this photocathode is clearly apparent.

Figure 6:
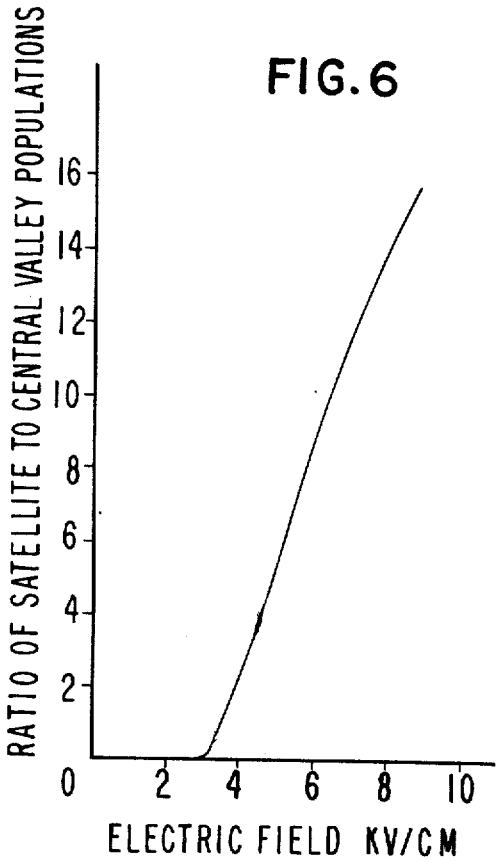
FIG. 6 is a plot of the satellite valley population versus electric field in a semiconductor of a type similar to that used in FIG. 4.

FIG. 6 shows the calculated ratio of electrons in the upper valleys of GaAs as a function of electric field from Butcher and Fawcett, Proc. Phys. Soc. 86, 1965, pages 1205 to 1219. It is clear that over 90% of the population can be transferred at reasonable fields. Similar transfer occurs in all semiconducting compounds with similar band structure to GaAs; Gunn oscillations have been observed in many of these, e.g. CdTe, InGaSb, GaAsP, InP, etc. InP is particularly relevant since the conduction band gamma to satellite valley spacing for InP is about 0.6 eV, i.e., greater than that of the quaternary system discussed here.

Figure 7:
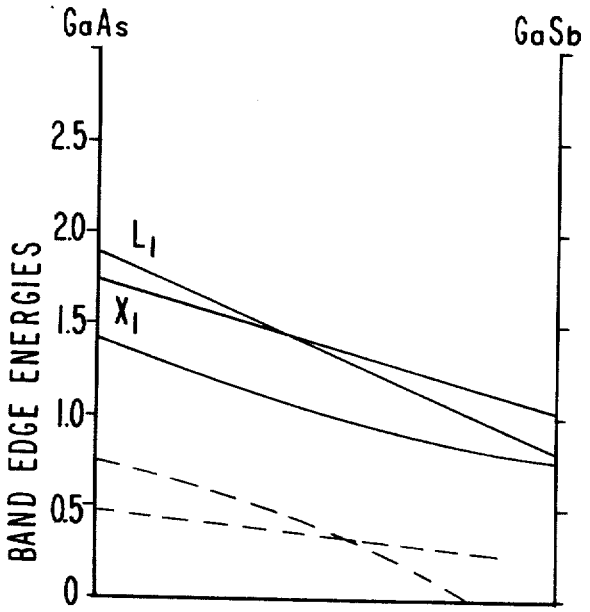
FIG. 7 is a band edge plot of a ternary system utilized in the cathode of FIG. 4.

The ternary GaAsSb alloy series of FIG. 7 provide another suitable band structure. The gamma-point bandgaps near the mid-composition range are suitable for strong absorption of 1.06-micron radiation, and the $L_1$ and $X_1$ satellite valleys are at a convenient height for obtaining emission over the surface barriers. Referring to the model of FIG. 4, for a barrier of height $E_B$, the lowest satellite valley would be at a height $E_{X,L} = E_B + E_G/3$. Using $E_B = 1.0$ eV as for $Cs_2O$ on Ag, the intersection of the dashed lines on FIG. 7 ($E_{X,L}$ - 1.0 eV and $E_G/3$) gives the composition of the lowest bandgap GaAsSb alloy that functions in the prescribed fashion—about 1.0 eV.

Figure 8:
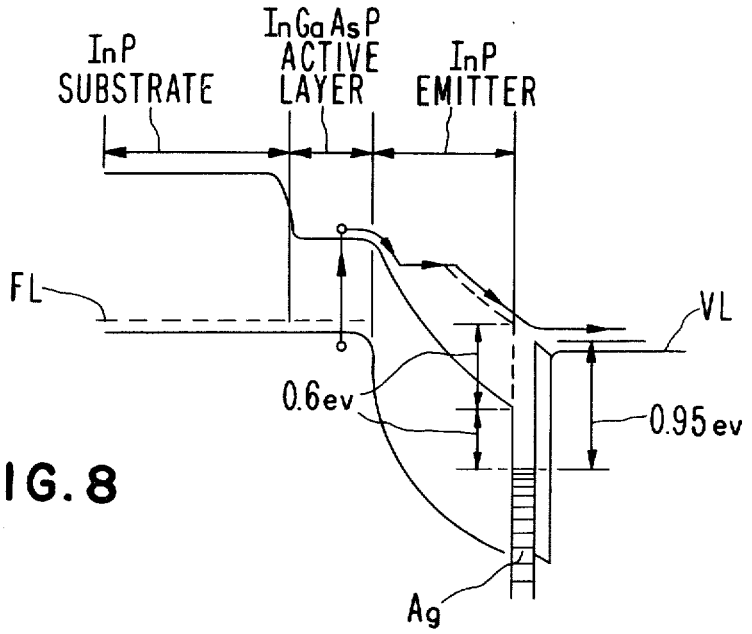
FIG. 8 is a band edge plot of an InP/InGaAsP/InP cathode.

We discuss next embodiments in which the functions of photon absorption and electron promotion are performed in separately-designated regions of a heterogeneous but continuous semiconductor body. FIG. 8 shows schematically such an arrangement. The active absorbing layer is a p-type InGaAsP quaternary layer grown lattice-matched on an InP substrate. Lattice-matched growth of this system yields a high performance 1.06-micron photocathode with excellent uniformity over large areas. The InGaAsP quaternary system with the InP lattice constant can generate bandgaps spanning the region from 1.35 eV (InP) to about 0.7 eV ($In_{0.63}Ga_{0.37}As$). The latter would be suitable for 1.75-micron operation. The doping of the active layer need not be as high as for an unbiased photocathode. Zinc doping of the order of $10^{16}$-$10^{17}/cm^3$ would be adequate, and would generate a correspondingly long diffusion length for this layer.

A few-micron thick (say 3 microns) lightly-doped emitter layer of InP is then grown on the quaternary. This layer is automatically lattice matched. It can be n or p-type, preferably the latter, and should be doped to less than $10^{15}/cm^3$. The device is completed by a 100-A thick metallic layer (e.g. Ag) deposited by vacuum evaporation, and activated by Cs and oxygen. This cathode would be illuminated by transmission through the InP substrate, transparent to all radiation beyond 0.9 micron.

In operation, a positive bias on the metallic contact depletes the lightly-doped InP emitter and establishes a field in it greater than $10^4$ V/cm. For such fields, which are low compared with breakdown fields ($10^5$ - $10^6$ V/cm), conduction electrons in InP are promoted into upper satellite valleys. These lie about 0.65 eV above the lowest central conduction band valley. FIG. 8 shows that at the surface these valleys are 1.2 eV above the Fermi level of the metal contact. The Ag-$Cs_2O$ barrier is of the order of 1 eV as determined by J. J. Uebbing and L. W. James in Journal of Applied Physics Vol. 41, pages 4505–4516, October 1970. Electrons from the upper valleys are therefore easily emitted into the vacuum. Promotion to the upper valleys in InP is an efficient process for fields greater than $2 \times 10^4$ V/cm.

Figure 9:
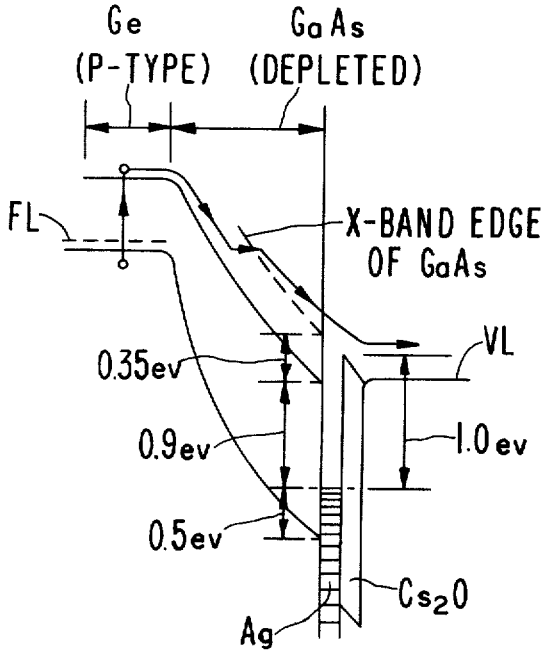
FIG. 9 is a band edge plot of a Ge/GaAs cathode.

An important practical advantage of InP is the characteristically high barrier height obtained on forming a metallic Schottky barrier to p-type material (or in other words the hole barrier height when biased in the direction shown in FIG. 8). This height is typically of the order of 0.75 eV. Such a high barrier prevents the flow of current from the Schottky barrier contact into the biased layer when the bias voltage is applied, preventing current drain on the biasing source and preventing also destruction of the thin Schottky barrier metallization and overlying (Cs,O) work-function-lowering layer referred to above as the activation layer FIG. 9 shows Ge/GaAs system analogous to the InGaAsP/InP system just described. Germanium possesses an indirect gap of 0.67 eV and a direct gap of about 0.8 eV at room temperature. The indirect gap rises to 0.7 eV at 200°K. The onset of direct absorption means that a high resolution photocathode can be fabricated for 1.5-microns wavelength, and the lower indirect gap implies that some imaging should be possible out to 1.75 microns. The lattice matched GaAs layer is doped to function as the electron promotion and hole barrier layer.

The inter-doping difficulties of growing GaAs on Ge can be minimized by use of a low-temperature transient liquid phase epitaxial technique. A cool Ge substrate is suddenly introduced into a Ga melt saturated with As. The rapid cooling of the melt by the substrate forces rapid growth of a GaAs layer on the Ge without appreciable inter-contamination. Some grading, however, would be beneficial in order to remove any heterojunction band-discontinuities.

The thermal bandgap of Ge is the limiting element determining dark current in this cathode due to a thermally-excited diffusion current of magnitude given by a well-known expression $$J_d = 4(2\pi kT/h^2)^3(m_e m_h)^{3/2}(qD/Lp_o)\exp(-E_g/kT).$$

Where the symbols have their usually accepted meanings, For Ge at T = 300°K and a hole density $p_o = 10^{18}/cm^3$, we have $J_d = 10^{-6}$ A/cm², which is of course much too high, and indicates that all photocathodes relying on materials with bandgaps in the region of 0.67 eV or less must be cooled.

For a somewhat lower temperature of 200°K and allowing for an increase of $E_g$ to 0.7 eV at this temperature, we have $J_d = 2 + 10^{-14}$ A/cm², a more reasonable value for dark current. At 200°K, the thermionic emission from the $Cs_2O$ and its interface states is negligible by comparison.

The bias current at this temperature can be computed from the thermionic emission over the hole barrier of the Schottky contact on GaAs, which is about 0.5 eV. We have $$i_b = 4 \times 10^{-7} \text{ A/cm}^2 \text{ at T} = 200°\text{K}$$

and $$i_b = 10 \text{ mA/cm}^2 \text{ at T} = 300°\text{K}.$$

Figure 10:
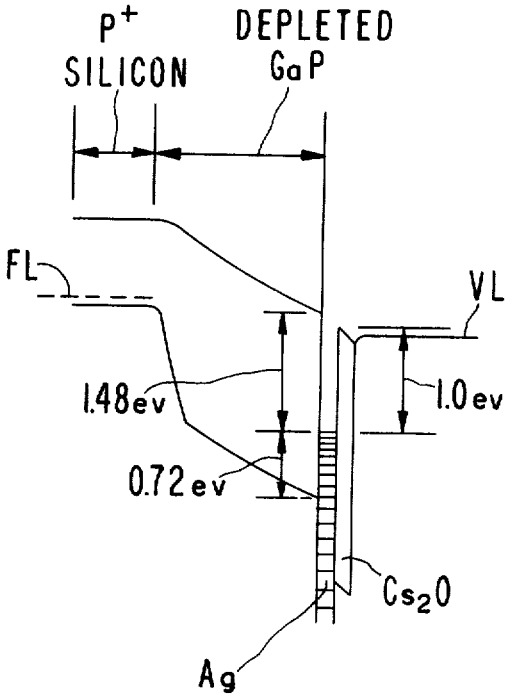
FIG. 10 is a band edge plot of a Si/GaP cathode.

FIG. 10 shows a similar situation with GaP grown on p-type Si. This growth can be carried out by vapor-phase methods. The resulting device will give some photoemission at 1.06 microns, which owing to the indirect Si bandgap will have a rather low efficiency-resolution product, but is of theoretical interest in that the GaP emitter can emit directly from the lowest conduction-band minimum over a Ag/$Cs_2O$ barrier.

One of the problems with present low bandgap negative affinity photocathodes is a dark current one or more orders of magnitude too high for some applications, at room temperature. This is a consequence of a low work function, which must of course be slightly lower than the photon energy in a passive cathode. Using the biased Schottky barrier cathode, a significantly higher work function surface may be used on the biased emitter, thereby reducing the dark current to the level of the thermally-excited diffusion current from the active layer, which will be adequately low at room temperature (about $10^{-15}$ A/cm² for a $10^{18}$ p-doped active layer).

FIG. 11 shows GaAs/InGaAs/InGaP field assisted photoemitter. The active layer is $In_{0.15}Ga_{0.85}As$, some microns thick (e.g. 5 microns), grown by graded vapor phase epitaxy process on a GaAs substrate. Light will be incident through this substrate. Such growth produces material of adequate quality when suitably graded. The lattice constant of the active layer is about 5.7 A.

A depletion layer about 3 thick of lightly-doped lattice-matching InGaP (approximately $In_{0.6}Ga_{0.4}P$) is grown on the active layer. At the lattice constant of 5.7A, the Γ conduction bandgap of InGaP is about 1.8 eV, and the X and L valleys lie at about 2.15 eV. Assuming a hole barrier of 0.75 eV for a surface metallic contact, the upper valley electrons have an energy in the metallic layer of 1.4 eV. They can therefore surmount a surface barrier of this magnitude, e.g. as provided by a layer of Cs over the Schottky barrier. The contribution of the metallic contact to thermionic emission is less than $10^{-16}$ A/cm² at 300°K. The contribution of the InGaP depletion layer, having a minimum bandgap of 1.75 eV, will be negligible ($<10^{-23}$ A/cm²) if the light doping is p-type.

Since this cathode is freed of the bandgap constraints imposed on a passive (unbiased) cathode by the surface interfacial barrier with $Cs_2O$, the basic absorption and transport processes are very efficient, and the ultimate cathode efficiency is determined by the transmission of the Schottky barrier, which can be high.

Yet another method for increasing the thermal energy of the electrons in the conduction level to promote them over the energy barrier employs the known optical pumping technique for pumping the electrons from the lower energy levels in the conduction band to higher levels. A source of pumping radiation illuminates the photocathode of the type shown in FIG. 1. of high intensity and of lower energy than the bandgap $E_G$ so that this pumping light does not promote electrons from the valence band to the conductance band. Because of the low cross-section for this process and the high intensity of light needed, this method of optical excitation is much less desirable than the intervalley transfer by electric field, described above.

The above discussion has ignored discontinuities in the conduction band edges at a heterojunction, which must be removed for proper operation of the two-layer embodiment. This removal can be effected by use of compositional grading combined with appropriate doping. Considering the discontinuity shown in FIG. 12 (*a*), improvement can be made (FIG. 12*b*) by $n^+$ doping of the early growth of the whole bandgap material. $10^{19}$ -level doping accomplishes band-bending in a distance of the order of 100 A. If now the bandgap is graded (via a lattic compositional change) over the region indicated by the vertical lines in FIG. 12*b*, a smooth conduction band edge is obtained as shown in FIG. 12*c*. The natural occurrence of smooth changes of composition, rather than the fictitious step change of FIG. 12*a*, is a feature of liquid phase epitaxial growth, due to melt-back and regrowth on contacting a substrate with a nonequilibrium melt. In the case considered here, the rest of the emitter layer would be grown lightly p-type.

What is claimed is:

1. In a photoemitter cathode for producing electron emission into vacuum, a semiconductor body comprising a mixed III-V semiconductor compound having a photoemission surface, and an activation layer on said photoemission surface, said semiconductor compound having a composition such that said semiconductor compound is direct gap, having a direct-gap conduction band valley, but having an indirect-gap conduction band valley lying at most 0.2 eV above the bottom of the direct gap conduction band valley, said indirect-gap valley having a higher density of states than said direct gap valley, whereby electron emission is promoted from said indirect gap valley through said photoemission surface.

2. In a photoemitter cathode for producing electron emission into vacuum, a semiconductor body comprising a III-V material selected such that said material is direct gap having a direct-gap conduction band valley, but having an indirect gap conduction band valley lying above the bottom of the direct gap conduction band valley, said indirect gap valley having a higher density of states than the direct gap valley, and the bottom of said indirect gap valley being above the direct gap valley by an energy of no more than 1.5 times the energy difference between the top of the valence band and the bottom of the direct gap conduction band valley, said semiconductor body having at least a surface portion thereof having a metal forming a Schottky barrier thereon with an activation layer lying on said metal forming the Schottky barrier, and means for reverse-biasing said Schottky barrier sufficiently to produce an electric field in said surface portion sufficient to excite photo-generated electrons in said direct gap conduction band valley to an energy sufficient to permit transfer of said electrons into said indirect gap valley, to thereby promote electron emission from said indirect gap valley through said activation layer.

* * * * *